US006604308B1

(12) United States Patent
Robles

(10) Patent No.: US 6,604,308 B1
(45) Date of Patent: Aug. 12, 2003

(54) KEY WITH IDENTIFYING SYSTEM

(76) Inventor: Sergio F. Robles, Durango 2340, Vitacura, Santiago (CL)

( * ) Notice: Subject to any disclaimer, the term of this patent is extended or adjusted under 35 U.S.C. 154(b) by 0 days.

(21) Appl. No.: 09/427,258

(22) Filed: Oct. 25, 1999

(30) Foreign Application Priority Data

May 14, 1999 (CL) ..... 997-99

(51) Int. Cl.[7] ..... G09F 3/00

(52) U.S. Cl. ..... 40/330; 40/634; 40/649; 40/490; 70/460

(58) Field of Search ..... 40/330, 634, 649, 40/490, 611; 70/460, 456 R

(56) References Cited

U.S. PATENT DOCUMENTS

| | | | | | |
|---|---|---|---|---|---|
| 312,545 | A | * | 2/1885 | Zeilin | 40/330 |
| 1,322,815 | A | * | 11/1919 | Patterson | 40/330 |
| 2,109,268 | A | | 2/1938 | I'Anson | |
| 2,200,454 | A | | 5/1940 | Rahn | |
| 2,349,745 | A | | 5/1944 | Morris | |
| 2,533,006 | A | | 12/1950 | Goldsmith | |
| 2,759,279 | A | | 8/1956 | Schlage | |
| 2,781,594 | A | | 2/1957 | Stupell | |
| 2,928,195 | A | * | 3/1960 | Fischer | 40/634 |
| 3,093,920 | A | | 6/1963 | Epstein et al. | |
| 3,324,586 | A | * | 6/1967 | Mitchell | 40/330 |
| 4,188,741 | A | | 2/1980 | Levy | |
| 4,349,975 | A | | 9/1982 | Chubb | |
| 4,417,410 | A | * | 11/1983 | Freedom | 40/330 |
| 5,040,671 | A | * | 8/1991 | Hager | 40/661 X |
| 5,113,602 | A | | 5/1992 | Levine et al. | |
| 5,181,927 | A | | 1/1993 | Song | |
| 5,232,528 | A | | 8/1993 | Reznickenko et al. | |
| 5,577,403 | A | | 11/1996 | Steeley | |
| 5,782,024 | A | | 7/1998 | Pausch | |
| 5,870,917 | A | | 2/1999 | Mahot et al. | |
| 6,094,954 | A | * | 8/2000 | Carmen | 70/460 X |

FOREIGN PATENT DOCUMENTS

| | | |
|---|---|---|
| CL | 952-93 | 8/1992 |
| CL | 40092 | 1/1993 |
| DE | AS 1 096 242 | 12/1960 |
| DE | AS 1 132 466 | 6/1962 |
| DE | GM 77 26 372 | 12/1972 |
| DE | GM 89 09 907 U1 | 9/1989 |
| DE | GM 93 15 975 U1 | 2/1994 |
| DE | GM 94 00 490 U1 | 3/1994 |
| EP | 0 230 484 | 1/1986 |
| TW | 242907 | 3/1995 |
| TW | 250860 | 7/1995 |

* cited by examiner

*Primary Examiner*—Lynne H. Browne
*Assistant Examiner*—James M. Hewitt
(74) *Attorney, Agent, or Firm*—Knobbe, Martens, Olson & Bear, LLP

(57) ABSTRACT

A key includes a stem connected to a head and an identification system positioned within the head. The head has two opposing surfaces and an aperture that forms a visible area. The aperture extends along the opposing surfaces and interior walls of the aperture connect the opposing surfaces. The identification system is configured to be positioned within the aperture and includes a cover and an identification card that carries a key identification. When inserted, the cover extends across the visible area within the aperture so that the key identification is visible.

37 Claims, 7 Drawing Sheets

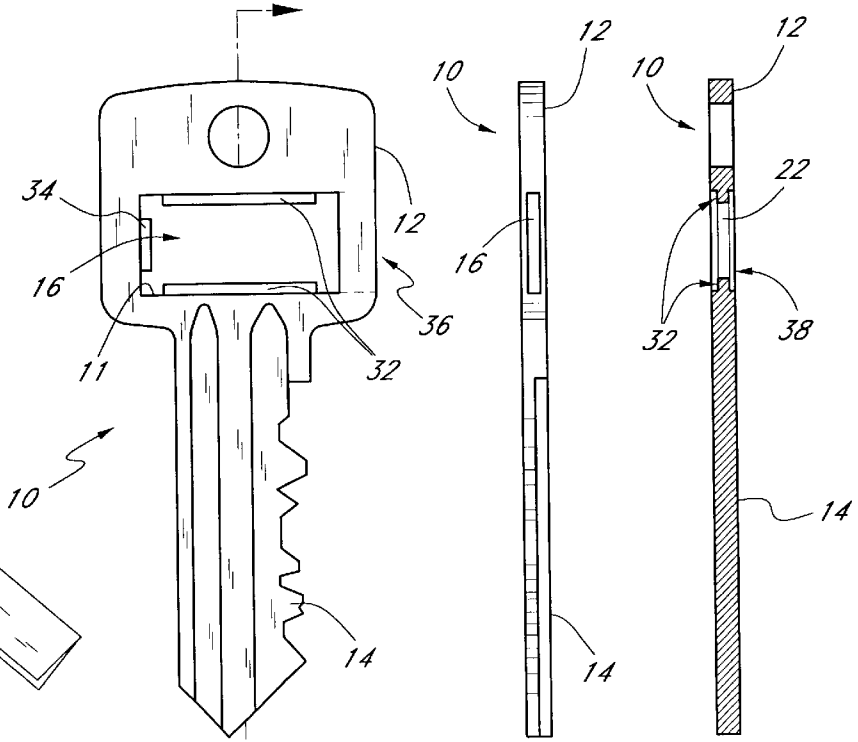
FIG. 10
FIG. 9
FIG. 8
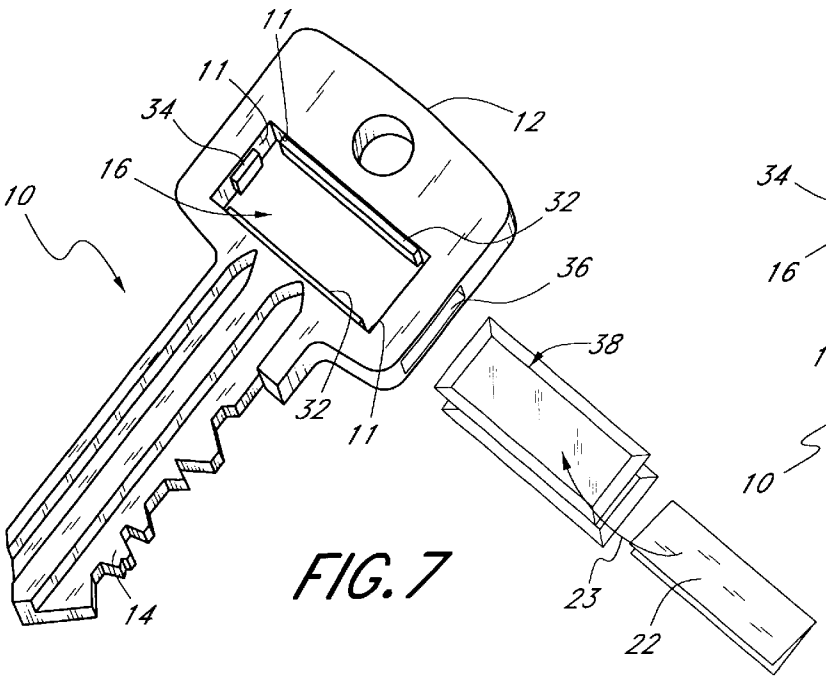
FIG. 7

KEY WITH IDENTIFYING SYSTEM

BACKGROUND OF THE INVENTION

1. Field of the Invention

The invention relates to a key with an identifying system, which makes the key easily distinguishable from other similar keys. More particularly, the invention relates to a key with an identifying system, such as a card, fit into an aperture of a head portion of the key.

2. Description of the related Art

The use of keys is increasing, due to an increased need for security. This has led to the development of the safety industries. For example, doors which in the past were kept open are now commonly locked with a key. Locks and hence keys have been incorporated in a number of appliances which formerly were not normally locked, such as refrigerators, freezers, various electric appliances and control panels, and the like. As a result, the use of locks, padlocks and their respective keys has increased greatly. In view of this trend, it is expected that the need for keys will continue to increase.

As a result of the increased use of keys, it is common to have a key chain with many keys. In such chains, it is difficult for a user to identify each key. This problem hinders the use of the keys and involves a significant loss of time when the user needs to try several keys in a lock or padlock until the correct one is found. Obviously, this problem is important when the user's key chain has keys for a house, an apartment complex, a commercial building, or a building undergoing construction. In the latter case, the construction manager may have to carry hundreds of keys for padlocks and locked doors.

In order to solve this problem both at home and in the commercial and industrial arena, various methods or systems have been created over time for the identification of keys. A majority of keys bear no identification at all, or at least bear no identification which lasts and remains reliable over time.

A widely used identification system for keys uses colors to distinguish the keys. For example, a colored rubber or plastic fitting adheres to a head portion of the key and partially covers the key head. Similarly, colored metal alloys, such as anodized aluminum, have been used in the key manufacturing industry to distinguish keys.

A disadvantage of the above methods is that the identifying means or accessory are normally separately manufactured increasing the costs for such methods. Also, the above methods do not fully solve the identification problem, because the user relies on his or her memory which color is for which lock or padlock. This makes this identification system not very reliable, because the user may forget the color-key assignment. Also, the number of colors used both in the colored keys and rubber head devices is limited, which makes it difficult to mark a large number of keys used by a person in a house or commercial building.

Another known identifying system uses the shape or design of the key or its head. For example, car manufactures use such a system in which a generally black plastic material embraces all or part of the key head and bears a stamped logotype or brand of the vehicle on it. This system is costly compared to the cost of the key itself and is only justified as an advertising means. Also it lacks a significant identification value as to which vehicle the key is intended for. Such a system is too expensive for domestic or commercial use and, further, does not comply with the fundamental requirement of accurately indicating the lock or padlock to which it belongs. On the other hand, the size of a key with a plastic form over the head of the key makes it difficult to handle more than three or four keys on a key ring or key chain. In addition, a user would have to submit to the key manufacturer a list that instructs the key manufacture how each key should be marked. Obviously this solution is not very practicable.

In addition to the industrial or semi-industrial methods described in the preceding paragraphs, relatively crude and home-made devices have been used in attempts to solve the problem of key identification. For example, wedges, holes or scratches have been made in the key heads, and the keys and locks have been assigned with numbers. However, all these actions have been ineffective, as with the passing of time the meaning of such marks is forgotten.

In attempts to solve this identification problem, it is known to use a plastic card case where the key destination is recorded in the card. This card case is attached to the key by means of a ring. Although this system solves the memory-associated problem, it duplicates or triplicates the price of the key, which is the main product. It also has the serious inconvenience of substantially increasing the volume of the key rings bearing such keys. For this reason, in addition to its high price, the system is not practical.

U.S. Pat. No. 4,417,410 describes a key that has a flexible strip attached to the head of the key to identify the key. The flexible strip is a plastic or rubber strip and is secured by various mechanisms which are difficult to implement due to the limited space available. To provide an identification system desired information is directly stamped on the plastic or flexible material. A disadvantage is that the stamped information may be become illegible or completely erased when the user repeatedly touches the key head. Another disadvantage is that it is difficult to write on the strip using an ordinary pencil or a pen.

U.S. Pat. No. 2,533,006 discloses a key that includes an identification strip. The strip is formed by a hard material which makes it difficult to write the desired information on it. Furthermore, the fastening means used for the identification or strips is far from being practical and safe. For example, the identification strip adheres to the key by folding itself around and embracing the central part between the slots without a reliable fastening system. Thus, after a short time it may become loose and the identification may be lost.

SUMMARY OF THE INVENTION

An aspect of the invention involves a key that has a stem connected to a head and an identification system positioned within the head. The head has two opposing surfaces and an aperture that forms a visible area. The aperture extends along the opposing surfaces and interior walls of the aperture connect the opposing surfaces. The identification system is configured to be positioned within the aperture and includes a cover and an identification card that carries a key identification. When inserted, the cover extends across the visible area within the aperture so that the key identification is visible.

Another aspect of the invention involves a method of identifying a key having a stem connected to a head. The head is provided with an aperture which forms a visible area and extends along opposing surfaces of the head. Interior walls of the aperture connect the opposing surfaces. An identification system is inserted into the aperture and has a cover and an identification card carrying a key information. The cover extends across the visible area within the aperture so that the key information is visible.

The key in accordance with the invention provides an identification system that carries written identification which allows to accurately and permanently indicate the correct key-lock pairing. The identification system is easy to update when needed. In addition, the identification system can be manufactured at the same time the key is made, without adding extra cost. As the identification system is completely positioned within the key head and does not extend beyond the head's surfaces, no extra volume is added to the key head.

More particularly, a piece of metal is die-cast to form the key blank or bit—including the head and an extension or stem, which is subsequently abraded to form the key according to needs of the respective lock—and is manufactured by submitting the metal plates made of different alloys to press strokes or swaging.

The identification system is introduced and fixed within the aperture and may be fastened therein through rails, needles, a blank or other fastening means which form an integral part of the key and cannot be easily detached therefrom.

In one embodiment of the invention, the aperture of the key head has a tab or tongue fastened to one of the interior walls. The width and length of the tongue are slightly smaller than the receiving aperture, which leaves an open space between the tab and the remaining interior walls of the aperture. The remaining open space permits that the identification card, which includes paper or paperboard, is positioned within the aperture and protected by a transparent plastic, mica, polymer or equivalent flexible tubular material. The tab is slightly thinner than the remaining key body, with the purpose that once the duly protected identification card is introduced, the thickness of the identification system is substantially the same as that of the key's overall thickness, without increasing the total volume of the key.

In one embodiment of the invention, the key head is die-cast in order to form the aperture. The aperture has a generally rectangular shape and each interior wall includes a rail leaving a spacing in the center of the aperture. The rails are slightly thinner than the thickness of the key head. The identification card is introduced and positioned inside the aperture, and a pair of transparent protecting covers having a specially designed shape are press-fit into the aperture, holding the identification card therein. The protecting covers can be made of plastic, mica, or any transparent material which can be pressed and fit into the aperture.

In a further embodiment of the invention one rail is attached to one interior wall of the aperture and two elongate parallel bars are positioned in proximity of two ends of the rail and extend from the interior wall of the aperture. Each bar has a small spacing from a closing side of the aperture. The rail and the two bars are slightly thinner than the key head. An identification card can then be placed inside the aperture, covering the rail and the two bars on both sides, while a transparent protecting tubular material is inserted to cover the identification card.

In another embodiment of the invention, the aperture formed in the key head is a rectangular window and has a lateral slot which extends into the aperture. The interior walls of the aperture include trenches that serve as sliding slots for the identification system. The identification card and two transparent protecting covers are inserted through the lateral slot and slide along the sliding slots to fit into the aperture, with the identification card positioned at the center of the aperture and covered by the protecting covers.

After a key blank is produced by die-casting a metal plate, the key blank is subsequently machined by using a swaging system in order to provide it with the necessary combination and associate it with a given lock. One advantage of the present invention is that the key of the invention is manufactured by using the swaging system that is for manufacturing a conventional key. That is, by applying the same swaging strokes but using adequate matrices, instead of producing a common blank, another blank including the receiving aperture and its supplements (i.e., the tab, rails, needles, a blank or other fastening means) may be produced at the same time and in a same work process. Consequently, no additional cost is involved, except for the small identification card which is inexpensive.

In accordance with this advantageous production, the new key with a built-in identification system can be marketed at a price that is competitive with that of a conventional key which lacks an identification system. For the same reason, the new key is widely applicable, for example, at home, in the commercial, industrial, automobile and other fields.

Thus, the advantages of this new key include that without significant additional cost, a key can be marketed which incorporates a written, accurate and permanent identification system, without altering its volume.

The invention is not restricted to the illustrated embodiment, but it may be varied without departing from the scope of the inventive concept.

BRIEF DESCRIPTION OF THE DRAWINGS

These and other aspects, advantages, and novel features of the invention will become apparent upon reading the following detailed description and upon reference to the accompanying drawings.

FIGS. 7–10 show a perspective view, a front view, a side view and a lateral cross-sectional view, respectively, of a third embodiment of a key according to the invention with an identification system.

DETAILED DESCRIPTION OF THE PREFERRED EMBODIMENT

The present invention is described in more detail with reference to a key that has a flat head and a flat stem. It is contemplated that a conventional key has been selected for the purposes of illustration and description only and is not intended to limit the invention to a generally flat shape. Those skilled in the art will appreciate that the invention is equally applicable to other shapes of keys.

Figure 3:
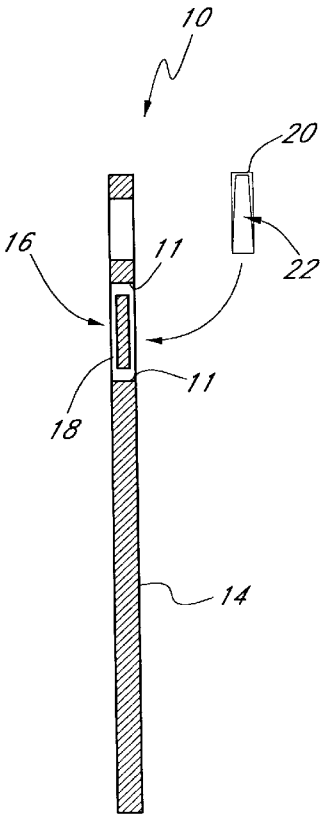
FIG. 3 shows a lateral cross-sectional view of the key shown in FIG. 1.
Figure 2:
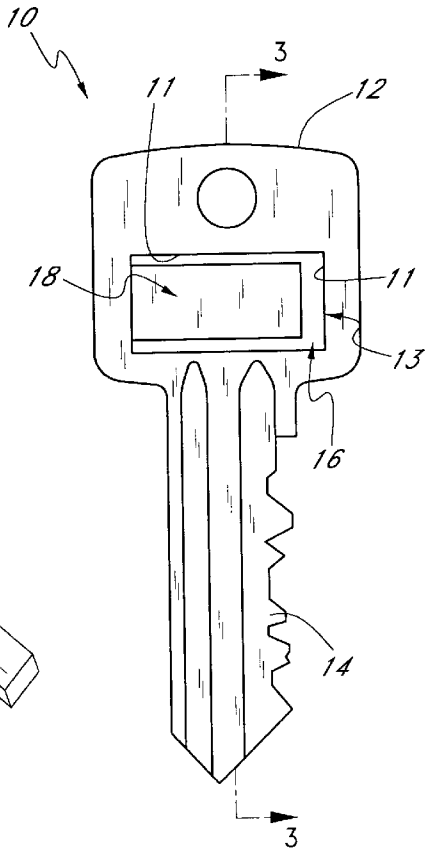
FIG. 2 shows a front view of the key shown in FIG. 1.
Figure 1:
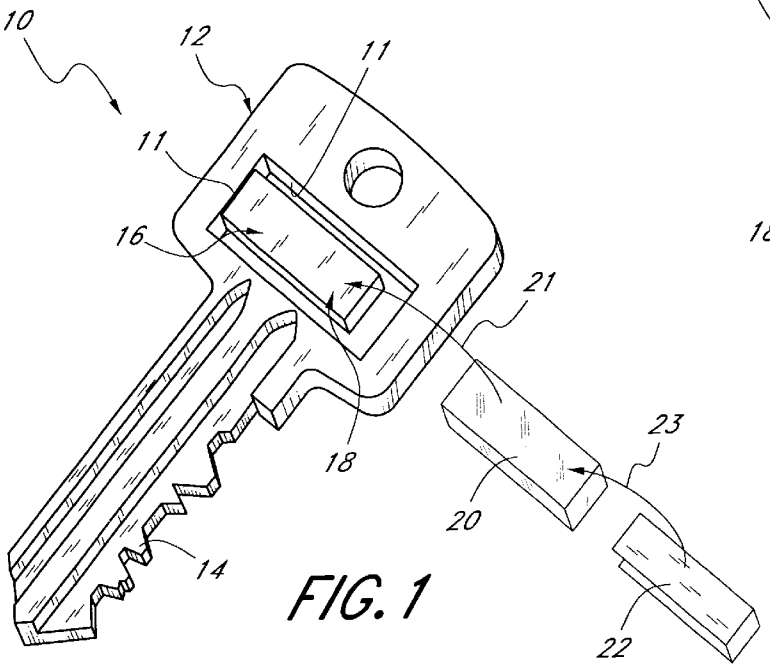
FIG. 1 shows a perspective view of a first embodiment of a key according to the invention with an identification system.

FIGS. 1–3 show a first embodiment of a key 10 with an identification system. The key 10 has a head portion 12, hereinafter referred to as the head 12, and a stem 14 connected to the head 12. The head 12 has an aperture 16 which receives the identification system. In the illustrated embodiment, the aperture 16 has a generally rectangular shape with four interior walls 11: two parallel long walls and two parallel short walls. Within the aperture 16 a tab 18 is attached to one of the short walls 11 and receives the identification system so that the identification system is essentially positioned within the aperture 16.

The identification system includes an identification card 22 and a cover 20 which are assembled and inserted into the aperture 16 as illustrated through arrows 21, 22. In one embodiment, the identification card 22 is a paper or paperboard material with at least one side suitable for receiving written information. The identification card 22 is, for example, folded into halves to essentially cover both sides of the tab 18. The side of the identification card 22 that includes the written information faces outside. The identification card 22 has a size that is substantially the same as that of the tab 18. It is contemplated that the identification card 22 may be cover only one side of the tab 18. In addition, the folded identification card 22 may be replaced by two separate, smaller cards, one for each side of the identification system.

The cover 20 is a transparent protective material, for example, plastic, mica or polymer, and formed as a sleeve having at least one open end. In one embodiment, the cover 20 has two open ends. It is contemplated that in another embodiment the cover 20 may have one open end and one closed end. The cover 20 slips, open end fist, over the identification card 22 with the tab 18 being surrounded by the identification card 22. The cover 20, thus, covers and protects the information carrying outside of the identification card 22.

As shown in FIG. 2, which shows a front view of the key 10, the tab 18 has a shape that corresponds to the shape of the aperture 16. As shown, the tab 18 has a rectangular shape, but is smaller and thinner than the aperture 16. Since the tab 18 is smaller than the aperture 16, a spacing is left between the tab 18 and the interior walls 11 of the aperture 16.

In one embodiment, the aperture 16 is fabricated at the same time the stem 14 is swaged. For example, the aperture 16 may be punched out from the head 12. The tab 18 may then be attached to one of the interior walls 11. In another embodiment, the tab 18 may be made through cutting a part of the head 12 out and leaving the tab 18 inside the aperture 16. The thickness of the tab 18 may be reduced as desired.

In one embodiment, a free end of the tab 18 may be beveled to assist sliding the cover 20 over the tab 18. In addition, an edge section 13 of the aperture 16 also may be beveled to further assist inserting the identification system into the aperture 16.

FIG. 3 shows a lateral cross-sectional view of the key 10 and an illustration of how the cover 20 covers the identification card 22 so that it is secured and protected during use. The cover 20 is removable so that the identification information can be updated. The combined thickness of the tab 18, the identification card 22 and the cover 20 is selected so that the total thickness of the assembled key 10 does not exceed the original thickness of the head 12.

Figure 6:
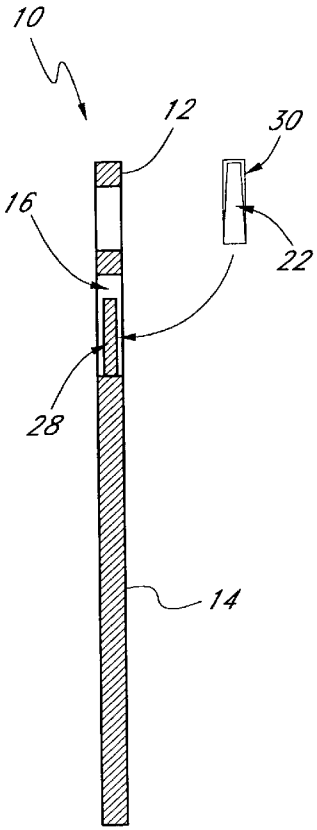
FIGS. 4–6 show a perspective, a front view and a side view, respectively, of a second embodiment of a key according to the invention with an identification system.
Figure 5:
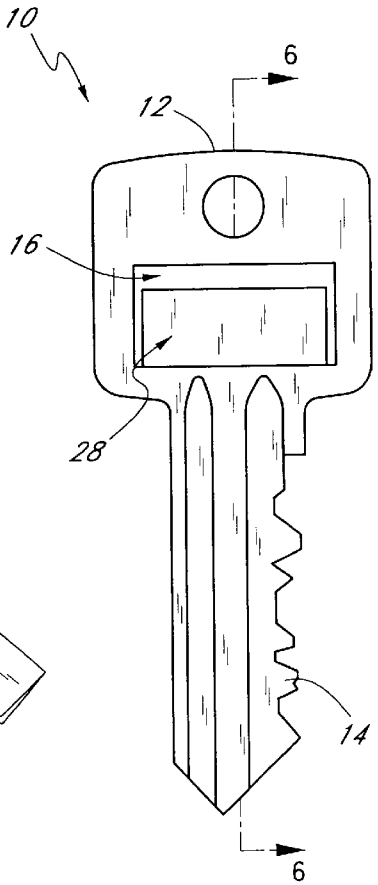
Figure 4:
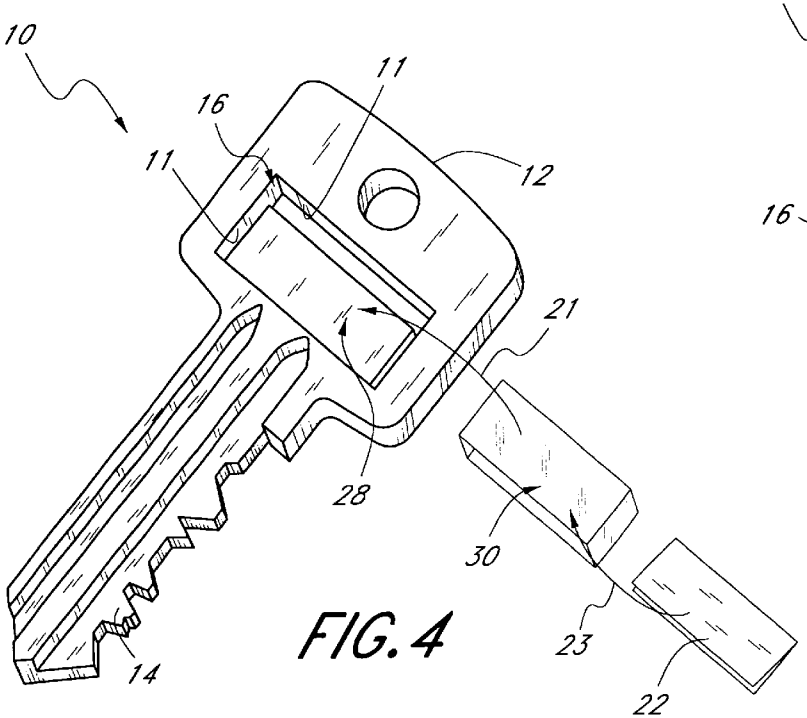

FIGS. 4–6 show a perspective, a front view and a lateral cross-sectional view, respectively, of a second embodiment of a key 10 with an identification system. The key 10 has an aperture 16 with a tab 28 positioned therein. The aperture 16, which has four interior walls 11, and the tab 28 have both rectangular shapes. Unlike in the first embodiment, the tab 28 is attached to one of the long interior walls 11. The tab 28 receives the identification system in a direction along a longitudinal axis of the key 10.

The identification system includes an identification card 22 and a cover 30 which are assembled and inserted into the aperture 16 as illustrated through arrows 21, 23. As in the first embodiment, the identification card 22 is a paper or paperboard material with at least one side suitable for receiving written information. The identification card 22 is folded into halves to essentially cover both sides of the tab 28. The side of the identification card 22 that includes the written information faces outside. The identification card 22 has a size that is substantially the same as that of the tab 28. It is contemplated that instead of the folded identification card 22, two separate, smaller cards, or a single card at only one side of the identification system may be used.

The cover 30 is a transparent protective material, for example, plastic, mica or polymer, and formed as a sleeve having one open end and a closed end. The cover 30 slips, open end fist, over the identification card 22 with the tab 28 being wrapped therein. The cover 30, thus, covers and protects the outside of the identification card 22. The 28 and an upper edge portion of the aperture 16 may be beveled to ease inserting the identification system into the aperture 16.

Regarding a description of the front view of the key 10 shown in FIG. 5 and the cross sectional view of FIG. 6, reference is made to the description of FIGS. 2 and 3. Hereinafter, the identification system used in the following embodiments is generally formed by an identification card and a transparent cover that covers the identification card as explained above. The identification card may be formed by a folded card, two separate cards, or a single card for only one side of the identification system. Further, the keys of the following embodiments each have a head 12 and a stem 14.

FIGS. 7–10 show a perspective view, a front view, a side view and a lateral cross-sectional view, respectively, of a third embodiment of a key 10 with an identification system. A head 12 of the key 10 has an aperture 16 which receives the identification system. In the illustrated embodiment, the aperture 16 has a rectangular shape and four interior walls 11: two parallel long walls and two parallel short walls. The long walls 11 include rails 32 that extend along the long walls 11, and one of the short walls 11 includes a rail 34 and the other short wall 11 includes a slot 36. The slot 36 is sized so that the identification system formed by an identification card 22 and a cover 38 can be inserted and pushed into the aperture 16.

In one embodiment, the cover 38 is configured to receive the folded identification card 22 between two protective surfaces. For example, the cover 38 may have an opening or a slot that receives the identification card 22. The cover 38, with the identification card 22 positioned, is inserted into the slot 36 and pushed into the aperture 16 until it is properly located and the information on the identification card 22 is visible. The key 10 is configured to prevent the identification card 22 being dislodged or falling out. In addition, the identification system can be secured within the key 10, for example, through application of glue, fasteners (screws) or heat treatment.

Figure 13:
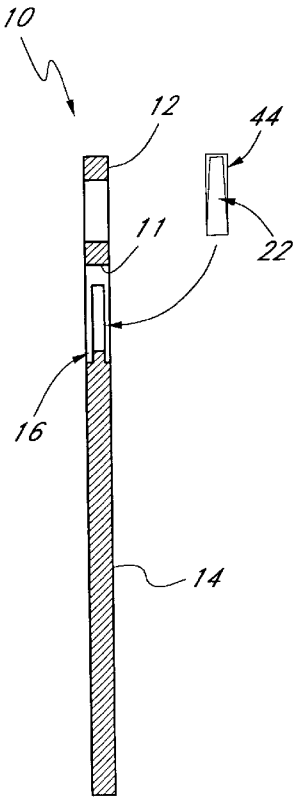
FIGS. 11–13 show a perspective view, a front view and a lateral cross-sectional view, respectively, of a fourth embodiment of a key according to the invention with an identification system.
Figure 12:
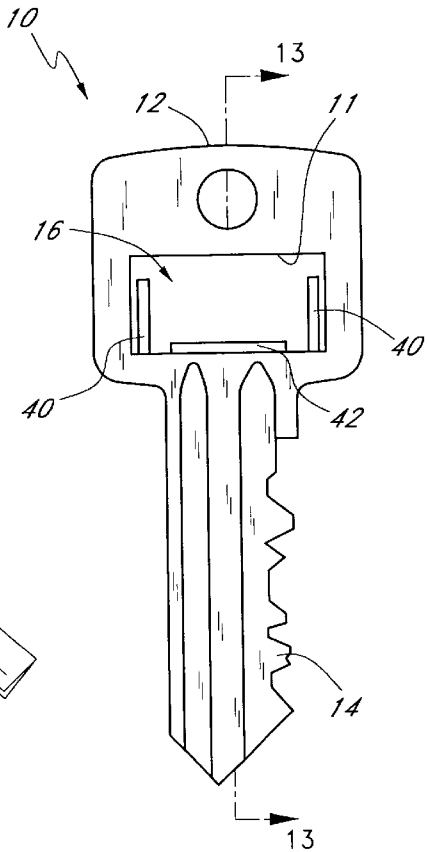
Figure 11:
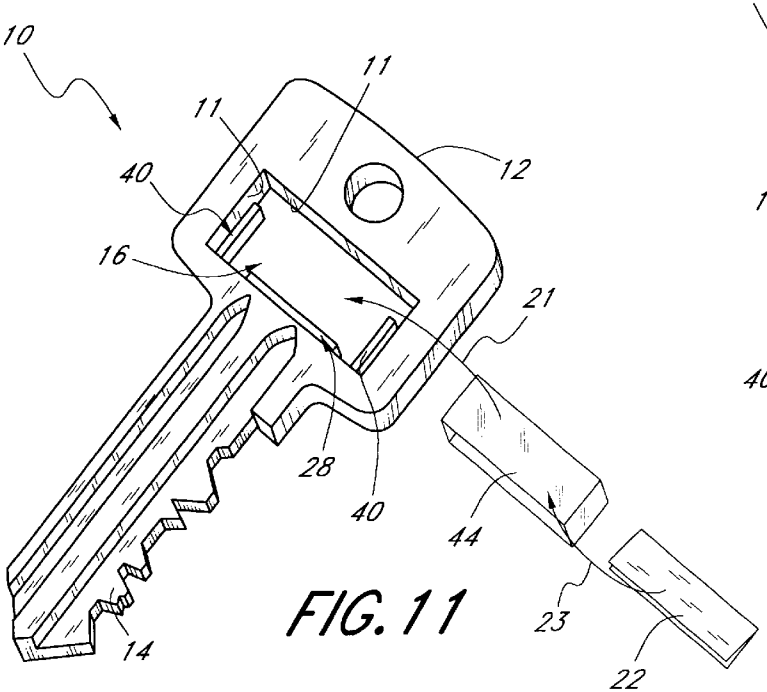

FIGS. 11–13 show a perspective view, a front view and a lateral cross-sectional view, respectively, of a fourth embodiment of a key 10 according to the invention with an identification system. A head 12 of the key 10 is attached to a stem 14 and has an aperture 16 which receives the identification system. In the illustrated embodiment, the aperture 16 has a rectangular shape and four interior walls 11: two parallel long walls and two parallel short walls. The long wall 11 that is in proximity of the stem 14 includes a rail 42 that extends along the long wall 11. In addition, two projections comprising elongate posts or bars 40 extend on both sides of the rail 42 from the long wall 11 into the aperture 16. The elongate bars 40 and the rail 42 receive a cover 44 that includes a folded identification card 22. The cover 44 and the identification card 22 are part of the identification system.

As shown in FIG. 12, the elongate bars 40 are positioned at a predetermined distance from the short walls 11 and at a predetermined distance from the rail 42. The identification card 22 is in one embodiment large enough to cover the two bars 40 and the rail 42. The folded identification card 22 is inserted into the cover 44 as shown in FIG. 13, and both are placed over the bars 40 and the rail 42 (arrows 21, 23). The identification system may be secured within the key 10, for example, through glue, screws, or a thermal process.

Figure 16:
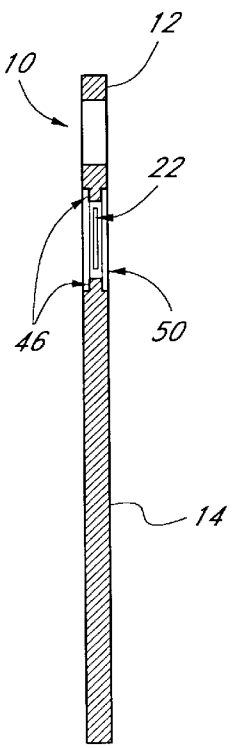
FIGS. 14—16 show a perspective view, a front view and a lateral cross-sectional view, respectively, of a fifth embodiment of a key according to the invention with an identification system.
Figure 15:
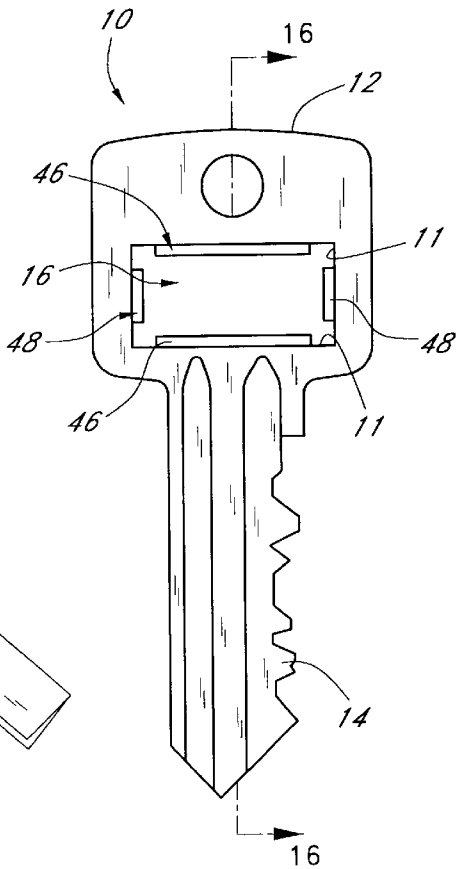
Figure 14:
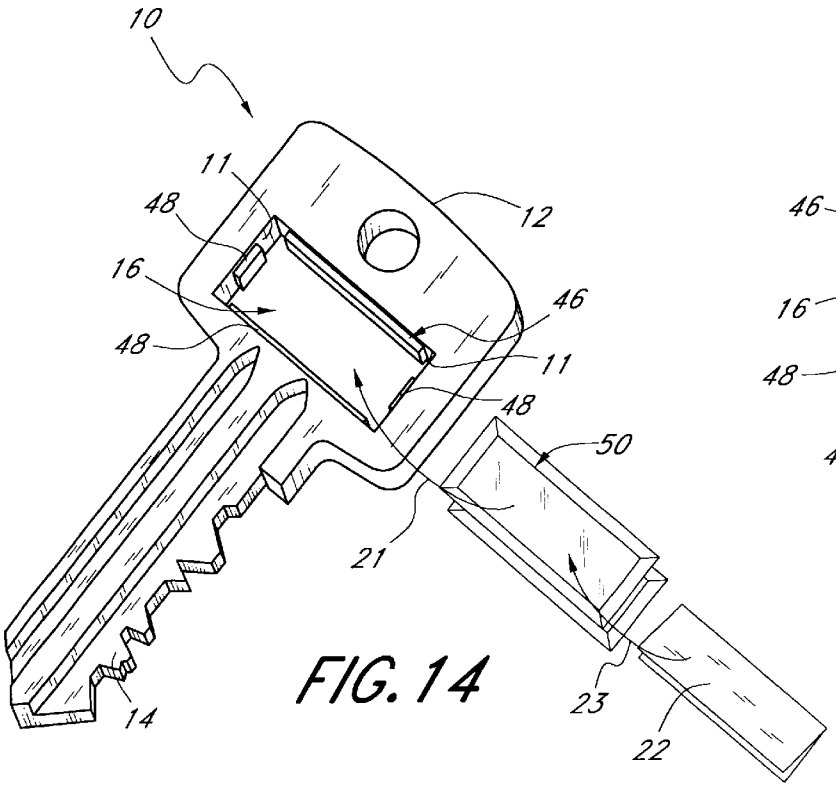

FIGS. 14–16 show a perspective view, a front view and a lateral cross-sectional view, respectively, of a fifth embodiment of a key 10 with an identification system. A head 12 of the key 10 has an aperture 16 which receives the identification system. In the illustrated embodiment, the aperture 16 has a rectangular shape and four interior walls 11: two parallel long walls and two parallel short walls. Each long wall 11 includes a rail 46 and each short wall 11 includes a rail 48. The aperture 16 in combination with the rails 48, 46 is configured to receive the identification system formed by an identification card 22 and a cover 50.

The rails 48, 46 are slightly thinner than the thickness of the key head 12. In one embodiment, the cover 50 includes a pair of transparent protecting covers which are sized and shaped so that they can be press-fit into the aperture 16, holding the identification card 22 therein. The protecting covers can be made of plastic, mica, or any transparent material which can be pressed and fit into the aperture 16.

Figure 19:
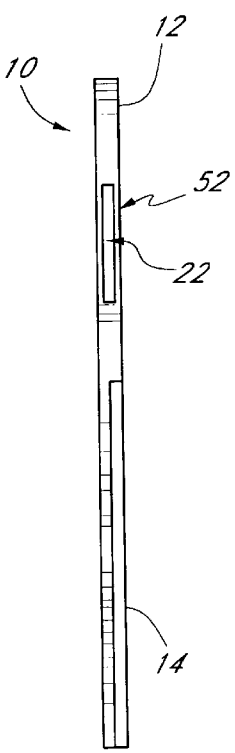
FIGS. 17–19 show a perspective view, a front view and a lateral cross-sectional view, respectively, of a sixth embodiment of a key according to the invention with an identification system.
Figure 18:
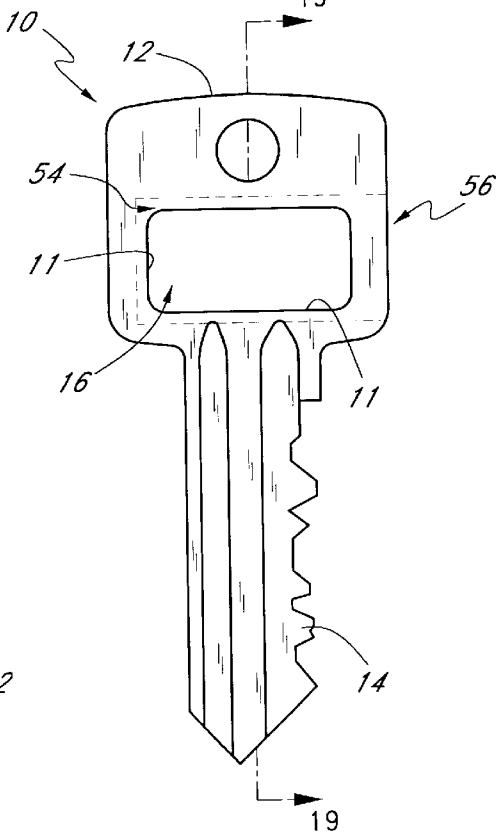
Figure 17:
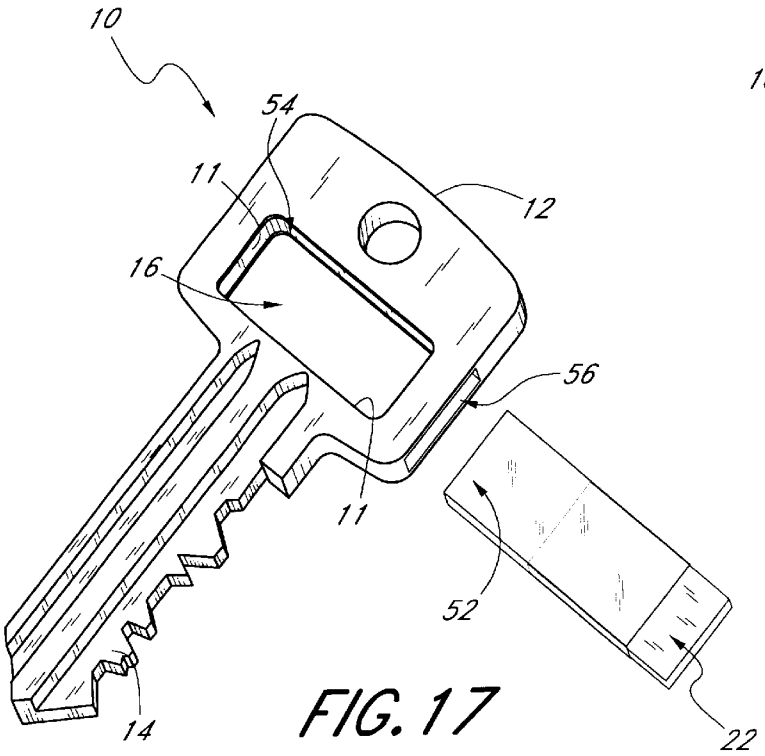
Figure 22:
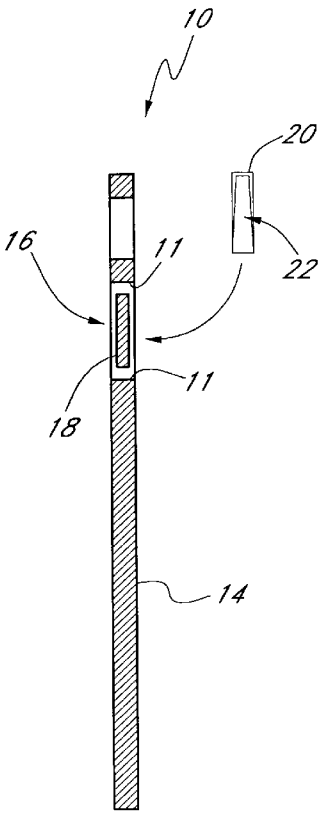
FIGS. 20–23 show a perspective view, a front view, a lateral cross-sectional view and a cross-sectional view taken along line A—A in FIG. 21 in the direction indicated by the arrows, respectively, of a seventh embodiment of a key according to the invention with an identification system.

FIGS. 17–19 show a perspective view, a front view and a lateral cross-sectional view, respectively, of a sixth embodiment of a key 10 of the invention with an identification system. A head 12 of the key 10 has an aperture 16 which receives the identification system. In the illustrated embodiment, the aperture 16 has an essentially rectangular shape and four interior walls 11: two long walls and two short walls. One of the short walls and both long walls 11 include grooves 54 that extend along the walls 11. The other short wall 11 includes a slot 56, extending in the plane of the key lead 12 through the head and from aperture 16 to outside the key head 12. The slot 56 is sized so that the identification system formed by an identification card 22 and a cover 52 can be inserted and pushed into the aperture 16.

The grooves 54 form a sliding path inside the key head 12 for the identification system. The cover 52 includes a pair of transparent protecting covers capable of holding the identification card 22. The cover 52 slides through the slot 56, along the sliding path until it is completely inserted into the aperture 16 and the identification card 22 is visible through the aperture 16 on both sides of the key head 12.

Figure 21:
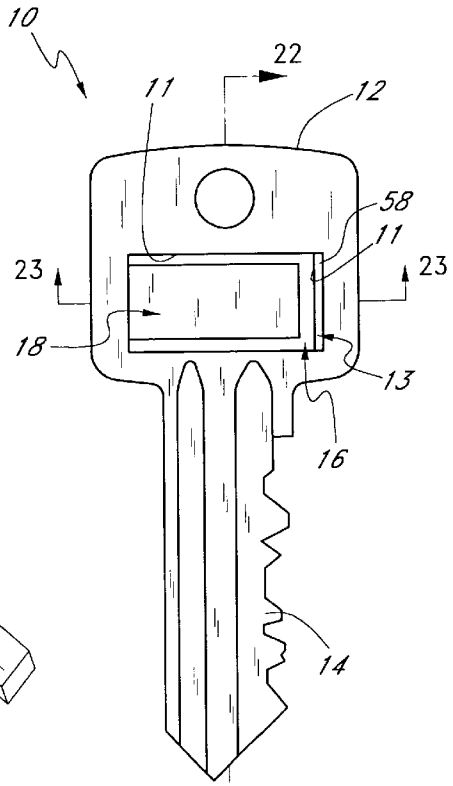
Figure 20:
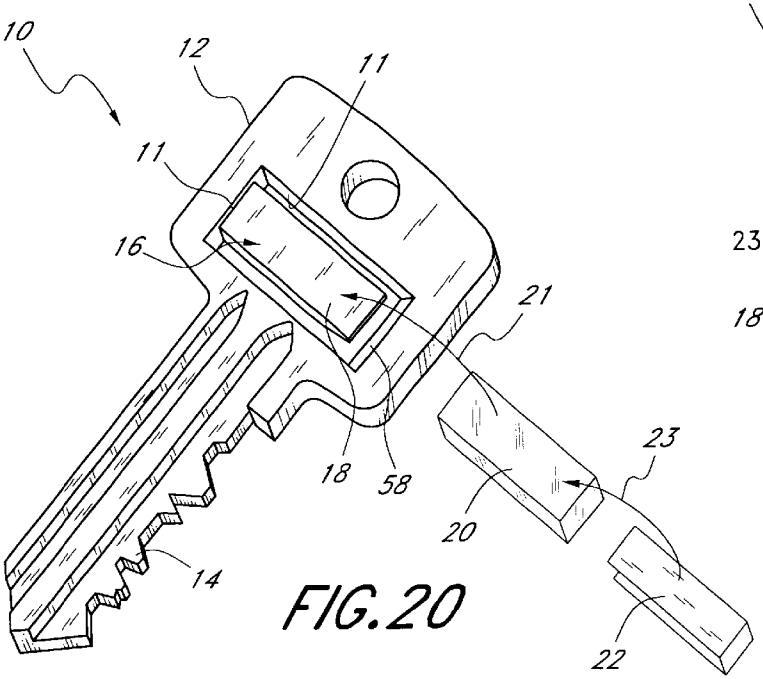
Figure 23:
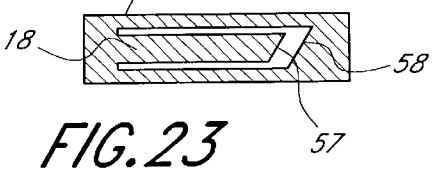

FIGS. 20–23 show a perspective view, a front view, a lateral cross-sectional view and a cross-sectional view, taken along line A—A in FIG. 21 in the direction indicated by the arrows, respectively, of a seventh embodiment of a key according to the invention with an identification system. More particularly, this embodiment is designed to facilitate placing the identification system over the tab 18. The free end of tab 18 has a bevelled or inclined surface 57. The adjacent interior wall has a similar bevelled or inclined surface 58, in the same direction as that on tab 18. These two surfaces, 57 and 58, are substantially parallel to each other and define a channel or passageway between them through which the identification system, in the form of cover 20 with card 22, can be slid to more easily fit the cover 20 over tab 18.

While the above detailed description has shown, described and identified several novel features of the invention as applied to a preferred embodiment, it will be understood that various omissions, substitutions and changes in the form and details of the described embodiments may be made by those skilled in the art without departing from the spirit of the invention. Accordingly, the scope of the invention should not be limited to the foregoing discussion, but should be defined by the appended claims.

What is claimed is:

1. A key, comprising:

a stem;

a head unitarily connected to the stem, the head having two opposing outer surfaces and an aperture having interior walls and forming a visible area, the aperture extending along the opposing surfaces with the interior walls connecting the opposing surfaces;

a tab extending into the aperture from a first one of the interior walls, the tab having a terminal end that is spaced from a second interior wall opposite the first wall; and an identification system positioned substantially within the aperture, the identification system including a cover and an identification card that carries key identification, the cover comprising a transparent sleeve having an open end to receive the identification card and configured to be slidable over the terminal end of the tab.

2. The key of claim 1, wherein the cover has two transparent surfaces, and wherein the identification card is located between the transparent surfaces so that the key identification is visible.

3. The key of claim 1, wherein the identification card includes a paper-like material.

4. The key of claim 3, wherein the identification card is foldable into halves.

5. The key of claim 1, wherein the cover includes a transparent protective material selected from the group consisting of plastic, mica, and polymer.

6. The key of claim 5, wherein the protective material is a flexible material.

7. The key of claim 1, wherein the identification card is smaller than the aperture.

8. The key of claim 1, wherein the identification system and the head have approximately the same thicknesses.

9. The key of claim 1, wherein the aperture has a rectangular shape having a pair of short interior walls and a pair of long interior walls, and wherein the tab extends from one of the short interior walls.

10. The key of claim 1, wherein the aperture has a rectangular shape having a pair of short interior walls and a pair of long interior walls, and wherein the tab extends from one of the long interior walls.

11. The key of claim 1, wherein the aperture and the tab have rectangular shapes, and wherein the tab is smaller than the aperture.

12. A key having an identification system, said key comprising a head portion having opposing first and second sides for gripping by a user, and a stem portion integrally connected to said head portion and shaped to operate a lock, said head portion having an aperture formed therethrough, said aperture defined by walls extending from the first side of said head to the second side, said aperture comprising one or more projections extending from a first aperture wall into said aperture, each of the one or more projections terminating at a free end that is spaced from a second aperture wall opposite the first wall, said one or more projections being adapted to receive said identification system over said free ends.

13. A key as claimed in claim 12, wherein said identification system comprises an identification member, for marking with information that identifies the key, and a pair of transparent outer members between which said identification member is located, so that said information is visible, said members adapted to cooperate with said one or more projections so as to be retained in said aperture.

14. A key as claimed in claim 12, wherein said one or more projections extend from said first aperture wall in the same plane as that of the key head and have edge surfaces that form a space between said surfaces and the other walls of the aperture, so that the identification system can be inserted into the aperture and on said one or more projections to display said information on either or both opposing sides of said key head.

15. A key as claimed in claim 12, wherein said key comprises only one projection in the form of a tab extending from only one of said walls within said aperture.

16. A key as claimed in claim 15, wherein said aperture and tab are generally rectangular or square.

17. A key as claimed in claim 16, wherein said aperture and tab are generally rectangular and said tab extends from one of the shorter sides of said aperture.

18. A key as claimed in claim 16, wherein said aperture and tab are generally rectangular and said tab extends from one of the longer sides of said aperture.

19. A key as claimed in claim 16, wherein said identification system comprises two sheets of transparent material joined along a common edge, so that said system is adapted to fit over said tab with a sheet on each of said opposing sides of said key head.

20. A key having an identification system, said key comprising a head portion having opposing first and second sides for gripping by a user, and a stem portion integrally connected to said head portion and shaped to operate a lock, said head portion having an aperture formed therethrough, said aperture defined by walls extending from the first side of said head to the second side, said aperture comprising one or more projections within said aperture, said one or more projections extending from at least one of said walls, said one or more projections comprising a plurality of rails on said at least one wall, the rails extending from said at least one wall in the same plane as that of the key head and having edge surfaces that form a space between said surfaces and the walls of the aperture, so that the identification system can be inserted into the aperture and on said rails to display said information on either or both opposing sides of said key head.

21. A key as claimed in claim 20, wherein said aperture is generally rectangular or square.

22. A key as claimed in claim 21, wherein said aperture is generally rectangular and comprises three rails with one on one of the shorter sides of said rectangular aperture and one on each of the longer sides of said aperture.

23. A key as claimed in claim 21, wherein said aperture is generally rectangular and comprises three rails with one on one of the longer sides of said rectangular aperture and one on each of the shorter sides of said aperture.

24. A key as claimed in claim 21, wherein said aperture is generally rectangular and comprises four rails with one on each side of said rectangular aperture.

25. A key as claimed in claim 22, wherein said key head has a passageway extending from one side of the head through to said aperture in alignment with said shorter sides, so that said identification system can be fed through said passageway into said rails.

26. A method of making a key with an identification system, said method comprising the steps of:

providing a key with a head portion connected to a stem portion;

forming an opening through the head portion;

forming one or more projections in said opening, each integrally connected to said head portion and extending from a first side of the opening toward a second side of the opening opposite the first side, a terminus of each of the one or more projections being within said opening and spaced from the second side of the opening;

said one or more projections being adapted to have attached thereto said identification system.

27. The method of claim 26, wherein one projection extends from a first side of the opening, and a second side of the opening opposite the first side is beveled.

28. A key, comprising:

a stem;

a head connected to the stem, the head having two opposing surfaces and an aperture that forms a visible area, the aperture having a rectangular shape and extending along the opposing surfaces, a pair of short interior walls and a pair of long interior walls of the aperture connecting the opposing surfaces, an elongate rail extending along one of the long interior walls, a pair of projections extending from the long interior wall on opposite ends of the elongate rail, each projection being spaced from the adjacent short interior wall and an end of the elongate rail; and an identification system positioned within the aperture and including a cover and an identification card that carries key identification, the cover extending across the visible area within the aperture.

29. The key of claim 28, wherein the projections receive the identification system.

30. A key, comprising:

a stem;

a head connected to the stem, the head having two opposing surfaces and an aperture that forms a visible area, the aperture extending along the opposing surfaces and interior walls of the aperture connecting the opposing surfaces; and an identification system positioned within the aperture and including a cover and an identification card that carries a key identification, the cover extending across the visible area within the aperture;

wherein the aperture has a rectangular shape having a pair of short interior walls and a pair of long interior walls, and wherein the aperture comprises a pair of first rails that extend along the long interior walls and a pair of second rails that extend along the short interior walls, the first and second rails receiving the identification system in a snap-fit manner.

31. A key having an identification system, said key comprising a head portion having opposing first and second sides for gripping by a user, and a stem portion connected to said head portion and shaped to operate a lock, said head portion having an aperture formed therethrough, said aperture defined by walls extending from the first side of said head to the second side, said aperture comprising one or more projections within said aperture, said one or more projections extending from at least a first one of said walls but not extending across the aperture to a second one of said walls generally opposite the first wall, said one or more projections being adapted to receive said identification system, said identification system comprising an identification member for marking with information that identifies the key, and a pair of transparent outer members between which said identification member is located so that said information is visible, said members adapted to cooperate with said one or more projections so as to be retained in said aperture, wherein said outer members are press fitted into said aperture and retained therein by said one or more projections.

32. A key having an identification system, said key comprising a head portion having opposing first and second sides for gripping by a user, and a stem portion connected to said head portion and shaped to operate a lock, said head portion having an aperture formed therethrough, said aperture defined by walls extending from the first side of said head to the second side, said aperture comprising one or more grooves within said aperture, said one or more grooves extending from at least one of said walls, said one or more grooves being adapted to receive said identification system, said identification system comprising an identification member for marking with information that identifies the key, and a pair of transparent outer members between which said identification member is located so that said information is visible, said members adapted to cooperate with said one or more grooves so as to be retained in said aperture, wherein said outer members are press fitted into said aperture and retained therein by said one or more grooves.

33. A key having an identification system, said key comprising a head portion having opposing first and second sides for gripping by a user, and a stem portion connected to said head portion and shaped to operate a lock, said head portion having an aperture formed therethrough, said aperture defined by walls extending from the first side of said head to the second side, said aperture comprising one or more projections within said aperture, said one or more projections extending from at least one of said walls in the same plane as that of the key head, said one or more projections having edge surfaces that form a space between said surfaces and a wall of the aperture so that the identification system can be inserted into the aperture and on said one or more projections to display said information on either or both opposing sides of said key head, wherein an edge surface of said one or more projections and a wall of said aperture are each beveled to form a channel between said beveled surfaces to facilitate attachment of said identification system to said one or more projections.

34. The key of claim 1, wherein the transparent sleeve has a second open end substantially opposite the first open end.

35. The key of claim 12, wherein the head portion and stem portion are unitarily formed.

36. The key of claim 26, further comprising sliding the identification system over said one or more projections.

37. A key as claimed in claim 15, wherein said identification system comprises a sleeve that fits over the free end of said tab.

* * * * *